United States Patent [19]

Childers

[11] 4,359,932

[45] Nov. 23, 1982

[54] HYDRAULIC ACTUATOR

[75] Inventor: Thomas W. Childers, Mandeville, La.

[73] Assignee: Exxon Production Research Co., Houston, Tex.

[21] Appl. No.: 276,555

[22] Filed: Jun. 23, 1981

Related U.S. Application Data

[63] Continuation of Ser. No. 861,061, Dec. 15, 1977, abandoned.

[51] Int. Cl.[3] ..... F01B 3/00

[52] U.S. Cl. ..... 92/31; 74/57; 74/89

[58] Field of Search ..... 92/7, 31, 33; 251/58, 251/229, 251, 252, 253, 263; 74/57, 89

[56] References Cited

U.S. PATENT DOCUMENTS

| | | | |
|---|---|---|---|
| 3,096,966 | 7/1963 | McFarland, Jr. | 251/251 |
| 3,319,925 | 5/1967 | Kojima et al. | 251/58 |
| 3,583,245 | 6/1971 | Schaefer | 92/31 |
| 3,585,669 | 6/1971 | Moret et al. | 92/31 |
| 3,602,478 | 8/1971 | Cairns | 251/58 |
| 3,881,516 | 5/1975 | Childers et al. | 137/625.44 |
| 3,989,223 | 10/1976 | Burkhardt et al. | 74/89.15 |
| 4,196,654 | 4/1980 | Stearns | 92/33 |
| 4,262,693 | 4/1981 | Giebeler | 251/58 |

*Primary Examiner*—Abraham Hershkovitz
*Assistant Examiner*—Richard L. Klein
*Attorney, Agent, or Firm*—John S. Schneider

[57] ABSTRACT

A spring cushioned static seal hydraulically operated actuator is disclosed which contains a hydraulically driven piston arranged to reciprocate in a chamber. A spring couples the piston to a rotatable shaft which limits the torque placed on the shaft by the piston in its drive stroke. A return spring functions to return the piston and drive spring to their initial positions upon release of the hydraulic drive applied to the piston. A static seal on the piston seals at the completion of the drive stroke of the piston. The actuator may be used to operate a subsea diverter to direct "pump down" or through flow line (TFL tools) through wye-branched flow passageways formed in a diverter body member located on a submerged well head.

4 Claims, 5 Drawing Figures

Oil
D1
D2

HYDRAULIC ACTUATOR

This is a continuation, of application Ser. No. 861,061, filed Dec. 15, 1977, now abandoned.

BACKGROUND OF THE INVENTION

1. Field of the Invention

The present invention concerns hydraulically operated actuators and, particularly, such actuators when used with diverters for directing the movement of tools used in conducting various operations on remotely located oil and/or gas wells, such as wells located subsea.

2. Description of the Prior Art

In performing completion and workover operations in subsea wells, tools are moved hydraulically into and out of well tubings through large radius flowline loops mounted on the submerged wells. In one type of subsea production system one pair of pump-down headers services several wells. Each well tubing is provided with wye-branched flow passageways to permit the conduct of operations either through a vertical conduit or through loops. Hydraulically operated tool diverters are required at each of the wells to enable the selective deflection of tools into the desired wells. A hydraulically operated TFL tool diverter designed to so direct passage of the TFL tools is shown and described in U.S. Pat. No. 3,881,516 entitled "Hydraulically Operated Diverter" by T. W. Childers et al. The hydraulically operated actuator of the present invention is an improvement in the actuator for such a diverter, particularly in the means for limiting the torsional force that can be generated on the paddle drive shaft of the diverter and in the means for effecting a static seal in the piston chamber.

SUMMARY OF THE INVENTION

In accordance with the teachings of the present invention an actuator assembly includes a hydraulically operable piston means including a chamber and a linearly movable piston reciprocal in the chamber, a rotatable drive shaft, and means connecting the piston to the drive shaft for converting linear motion of the piston to rotary motion of the drive shaft and for limiting the torsional force capable of being generated on the drive shaft by the piston. A static seal on the piston seals against an end wall of the chamber at the end of the drive stroke of the piston. The seal is an annular member, wedge shaped in cross section, having a deformable reduced contact area. In well operations the drive shaft may be used to cause a diverter paddle to pivot at the junction of wye-branched passageways for diverting TFL tools through either of the branched passageways. The actuator assembly is sealingly connectable to the diverter body member and is removable therefrom and replaceable thereon.

DESCRIPTION OF THE PREFERRED EMBODIMENTS

Figures 1, 2, 3, 4, 5:
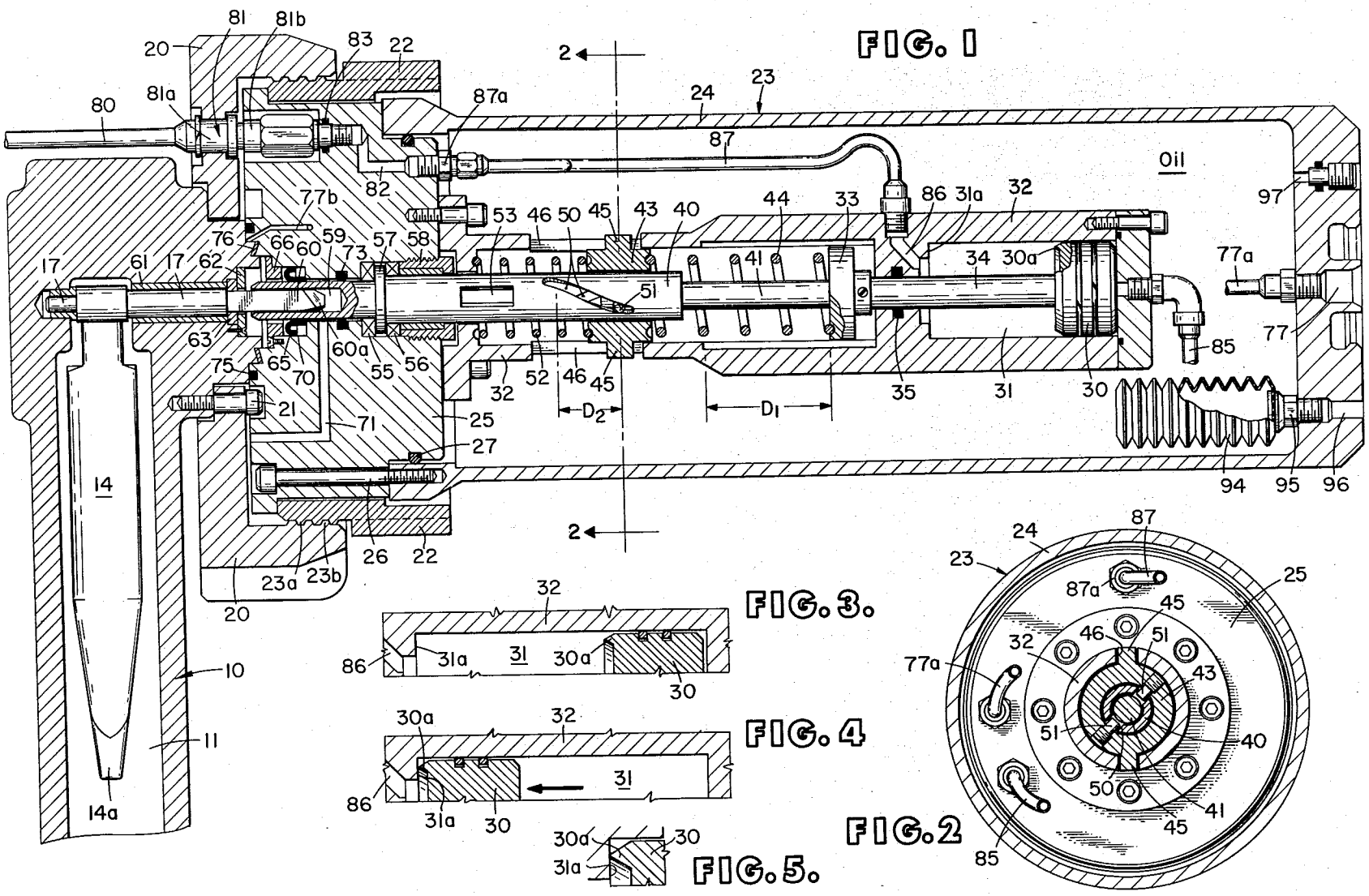
FIG. 1 is a partial vertical section through the actuator assembly of the invention and a tool diverter connected thereto.
FIG. 2 is a view taken along lines 2—2 of FIG. 1.
FIGS. 3, 4 and 5 are fragmentary views of the piston-chamber illustrated in FIG. 1.

Referring to the figures there is shown a diverter body 10 having wye-branched vertical bore 11 and a curved bore, not shown, which forms a smooth internal transition to a loop section, not shown. Diverter body 10 is the same as the diverter body shown and described in the aforementioned patent. A diverter paddle 14 is shaped to conform to the curved bore on its one side and to vertical bore 11 on its other side. The free end 14*a* of paddle 14 is tapered on both sides and engages the inner bore wall of the wye in each of its two positions. Paddle 14 is non-rotatably mounted on one end of a shaft 17 which extends through the wall of diverter body 10 at the junction of the bores. Shaft 17 serves as the axis of rotation for paddle 14. Diverter body 10 is connected to a threaded receiver flange 20 by threaded bolts 21. A threaded lock ring 22 is rotatably mounted on an operator or actuator assembly 23 and is connected by threads to receiver flange 20. Actuator assembly 23 includes a housing 24 secured to a closure plate 25 at one end by threaded bolts 26 (only one is shown). An o-ring 27 seals off the connecting inner surface of housing 24 and the outer surface of closure plate 25.

A large linearly movable piston 30 reciprocates in a chamber 31 formed in a cylindrical body member 32 from one position, shown in FIGS. 1 and 3, to another position, shown in FIGS. 4 and 5 (drive stroke) and from the other to the one position (return stroke). Piston 30 contains a static seal 30*a* which is an annular member, wedge shaped in cross section, having a deformable reduced contact area or edge. At the end of the drive stroke of piston 30 the edge contacts and seals on seat 31*a* of chamber 31. Under the compressive force of piston 30 the edge yields or plastically deforms to conform to seal 31*a*, as indicated in FIG. 5, to achieve intimate contact and a better seal. The quotient of piston forces (pressure times piston area) divided the seal contact area is slightly greater than the compressive strength of the piston material which results in the plastic deformation of edge 30*a*. The piston preferably is constructed of a soft malleable steel such as an annealed American Iron and Steel Institute (AISI) 1015 steel with a hardness in the range of 120 Brinnell Hardness Number (BHN). The cylinder and static seat 31*a* are constructed of a harder steel such as AISI 4130 with a hardness in the range of 235 BHN. Preferably, the seal edge is blunted to prevent failure of the steel seal. The reduced area (edge) of seal 30*a*also facilitates cutting through any particles or debris which may be in the fluid in chamber 31 and adhere to seat 31*a*. Annular piston rings 30*b* surround piston 30 but do not seal off the space between piston 30 and the wall of chamber 31. Piston 30 is connected to a drive plate 33 by means of a piston rod 34 which extends through an interior wall of body member 32. Shaft seal 35 seals off the annulus surrounding piston rod 34 within that wall. Drive plate 33, from which a shaft 41 extends into a hollow output drive shaft 40, is coupled to output shaft 40 by a cam or drive nut 43 and a cushioning coiled drive spring 44 positioned in body member 32 between plate 33 and one side of drive nut 43. Two external lug of pins 45 that ride in slots 46 formed in cylindrical body member 32 restrain drive nut 43 from rotating. Output drive shaft 40 has a pair of helical slots 50 which are engaged by cam pins 51 on drive nut 43. A coiled return spring 52 which has a lower spring constant than drive spring 44 surrounds drive shaft 40 between an end wall of body member 32 and the other side of cam nut 43 and urges drive nut 43 against the bias of drive spring 44. An open window 53 in drive shaft 40 prevents trapping of fluid within drive shaft 40.

Drive shaft 40 extends into closure plate 25 where it is mounted for rotation within thrust bearings 55 and 56 on each side of a shoulder 57 and within a support bearing 58 threaded to closure plate 25. The end of drive shaft 40 forms a socket 59 for receiving an end 60 of shaft 17. The interior cross section of socket 59 is configured the same as the cross section of shaft end 60. Such configuration is illustrated herein as square; however, other suitable shapes may be used. The cross section of the tip of shaft end 60 is reduced and configured as at 60*a* so that socket 59 will pick up shaft 17 regardless of its rotational position. A sleeve bushing 61 surrounds a portion of shaft 17 and a plate member 62 confines a retainer ring 63 against bushing 61. A pressure seal 65, retained in place by a plate member 66, provides a pressure seal between shaft 40 and closure plate inner wall 70. Other suitable pressure seals may be used. A bleeder passageway 71 is positioned in closure plate 25 and, communicates with the bore between o-ring seal 73 and seal 65 to prevent fluids which may escape by shaft seal 65 from entering housing 24. Any fluids that may escape past seal 65 will leak out between the course acme threads 23*a* and 23*b*. An annular o-ring 75 on the face of closure plate 25 enables a manipulator, not shown, to test the metal-to-metal ring seal 76 located between closure plate 25 and body 10. Test pressure is applied by the manipulator through a port 77 in housing 24 and fluid pressure line 77*a* connected thereto and a passageway 77*b* in closure plate 25 to which line 77*a* is connected. A port 86 in cylindrical body member 32 fluidly communicates chamber 31 on the exhaust side of piston 30 with a closed ambient pressure reservoir system (not shown) through a fluid conduit 87, a threaded connection 87*a* , a passageway 82, a poppet connector 81 and a conduit 80. Poppet connector 81 includes a female portion 81*b* attached to closure plate 25 and a male portion 81*a* attached to receiver flange 20. An o-ring 83 seals off the connection between portion 81*b* and closure plate 25.

A diaphragm member, bellows or bladder 94 is connected into a passageway 96 in the rear wall of housing 24 by means of a threaded connector 95. The interior of housing 24 is filled with oil through plugged opening 97. The interior of the bellows is open to ambient sea pressure (as is the aforementioned fluid reservoir system) and pressure is equalized inside and outside housing 24. Instead of the bellows arrangement pressure equalization could be achieved inside and outside housing 24 by connecting the housing to the fluid reservoir system through another conduit and connector in flange 20, closure plate 25 and another poppet valve connector arrangement (such as 81). A conduit 85 conducts power fluid to cylinder 31 from the poppet valve through a poppet valve connection, not shown.

Diverter body 10 and the components associated therewith and the closed hydraulic system are permanently located subsea adjacent the subsea wellhead. Actuator assembly 23 is disconnectable and removable from and reconnectable to diverter body 10 using remotely controlled manipulators or divers. When installing actuator assembly 23 it is positioned adjacent diverter body 10 and properly aligned therewith. The end 60 of shaft 17 enters socket 59 and, if necessary, is rotated as it enters by the slanted surfaces 60*a* at the tip of the shaft. The two halves of each of the poppet valves 81 engage and when the actuator assembly and diverter body 10 are positioned as shown in FIG. 1 lock ring 22 is rotated to thread it to receiver flange 20. Test pressure is then appied through port 77, hose 77*a* and passageway 77*b*.

When the actuator assembly is connected to a diverter and it is desired to divert tools from one bore of the diverter to the other, power fluid is supplied from the reservoir through conduit 85 to piston chamber 31 and piston 30 to move piston 30 in its drive stroke causing drive plate 33 to compress spring 44 which in turn acts on cam nut 43. As cam nut 43 is pushed axially by drive spring 44, drive shaft 40 is caused to rotate and return spring 52 to be compressed. Since the return spring has a lower spring constant than drive spring 44 cam nut 43 is moved linearly in the direction of return spring 52 when piston 30 applies force to drive spring 44. When piston 30 seats on seat 31*a*, piston rod 34 has moved the distance $D_1$. Biased by return spring 52 cam nut 43 moves the distance $D_2$, an approximate ratio of 1:2. As shown, out-put shaft 40 rotates in a counter clockwise direction when piston 30 moves from its right-hand to its left-hand position (drive stroke). At the end of the drive stroke the edge of seal 30*a* seats on seat 31*a* as indicated in FIG. 5. The spring coupling between the piston and the cam nut limits the torque on the output shaft and, also, allows the output shaft to be rotated in the opposite direction without moving the piston off its static seat. When power fluid is released from piston chamber 31 through conduit 85 to the reservoir, return spring 52 moves cam nut 43 linearly in the direction of drive spring 44 and moves piston 30 in its return stroke. Such movement causes out-put shaft 40 to rotate in a clockwise direction, as shown in FIG. 2, until piston 30, drive plate 33, spring 44, cam nut 43 and return spring 52 are positioned as shown in FIG. 1. In this arrangement the diverter operator can try to overdrive the diverter paddle 14 so that it is firmly held in the extreme positions without overstressing either the diverter paddle-shaft connection or the diverter paddle tip 14*a*. The actuator avoids causing damage to the diverter paddle drive shaft connection if TFL tools should be accidentally pushed under the paddle from the reverse direction or if tools or debris are in the way when the diverter is operated. It is designed to limit the torsional force that can be generated on the paddle drive shaft.

The actuator assembly shown and described herein limits the total force applied by the output shaft and is, also, self-adjusting and provides a reliable seal on a static heat. Changes and modifications may be made in the illustrative embodiments shown and described herein without departing from the scope of the invention as defined in the appended claims.

Having fully described the nature, objects, operation and advantages of my invention I claim:

1. Apparatus comprising:

a hydraulically operable piston assembly having a chamber;

a linearly moveable piston means arranged to reciprocate in said chamber and having a drive stroke and a return stroke;

a rotatable drive shaft means;

at least one curved slot formed in said drive shaft means;

a linearly moveable cam means having pin means engageable in said curved slot for rotating said drive shaft means upon movement of said cam means;

a drive spring engaging said piston means and said cam means for moving said cam means in the direction of the drive stroke of said piston means upon movement of said piston means in said drive stroke; and a return spring engaging said cam means for urging said cam means in the direction of said return stroke of said piston means.

2. Apparatus as recited in claim 1 including:

a cylindrical housing having at least one slot formed therein; and lug means formed on said cam means retained in said slot to prevent rotation of said cam means upon linear movement of said cam means.

3. Apparatus as recited in claim 2 in which said drive spring and said return spring each comprises a linearly extensible coiled spring, said return spring having a lower spring constant than said drive spring.

4. Apparatus as recited in claim 3 including thrust bearings surrounding said drive shaft means.

* * * * *